United States Patent [19]

Culotta

[11] Patent Number: 4,924,544

[45] Date of Patent: May 15, 1990

[54] EMERGENCY TOOL

[76] Inventor: Donald W. Culotta, 7563 Lockhaven Ave., Rancho Cucamonga, Calif. 91730

[21] Appl. No.: 435,034

[22] Filed: Nov. 9, 1989

[51] Int. Cl.[5] ..... B25F 1/00

[52] U.S. Cl. ..... 7/138; 7/166; 7/145; 7/169

[58] Field of Search ..... 7/166, 138, 169, 170, 7/143, 145

[56] References Cited

U.S. PATENT DOCUMENTS

| | | | |
|---|---|---|---|
| 866,931 | 9/1907 | Higgins | 7/169 |
| 1,405,250 | 1/1922 | Ambrose | 7/138 |
| 1,703,856 | 2/1929 | McKeag | 7/138 |
| 4,597,123 | 1/1986 | Cobe, Jr. | 7/166 |
| 4,646,378 | 3/1987 | Borden | 7/166 |
| 4,741,060 | 5/1988 | Hose | 7/138 |

OTHER PUBLICATIONS

"Shockproof Emergency Tool", Popular Science, p. 55, Aug., 1941.

Three Polaroid photographs of DESCO Spanner Wrench.

*Primary Examiner*—Roscoe V. Parker

*Attorney, Agent, or Firm*—Sheldon & Mak

[57] ABSTRACT

An emergency tool is provided capable of performing four post-catastrophe functions. The tool has a handle and a head. One end of the handle forms an open-end wrench socket useful in shutting off the water supply to a residence. The handle also defines a box-end wrench socket useful in shutting off valve to allow a home-owner to shut off the gas supply to a residence. The head comprises a rubbish claw to allow the tool to be used to dig through rubble and debris, and a wedge capable of prying open doorways and other enclosure access ways which may become stuck shut during a catastrophe.

20 Claims, 1 Drawing Sheet

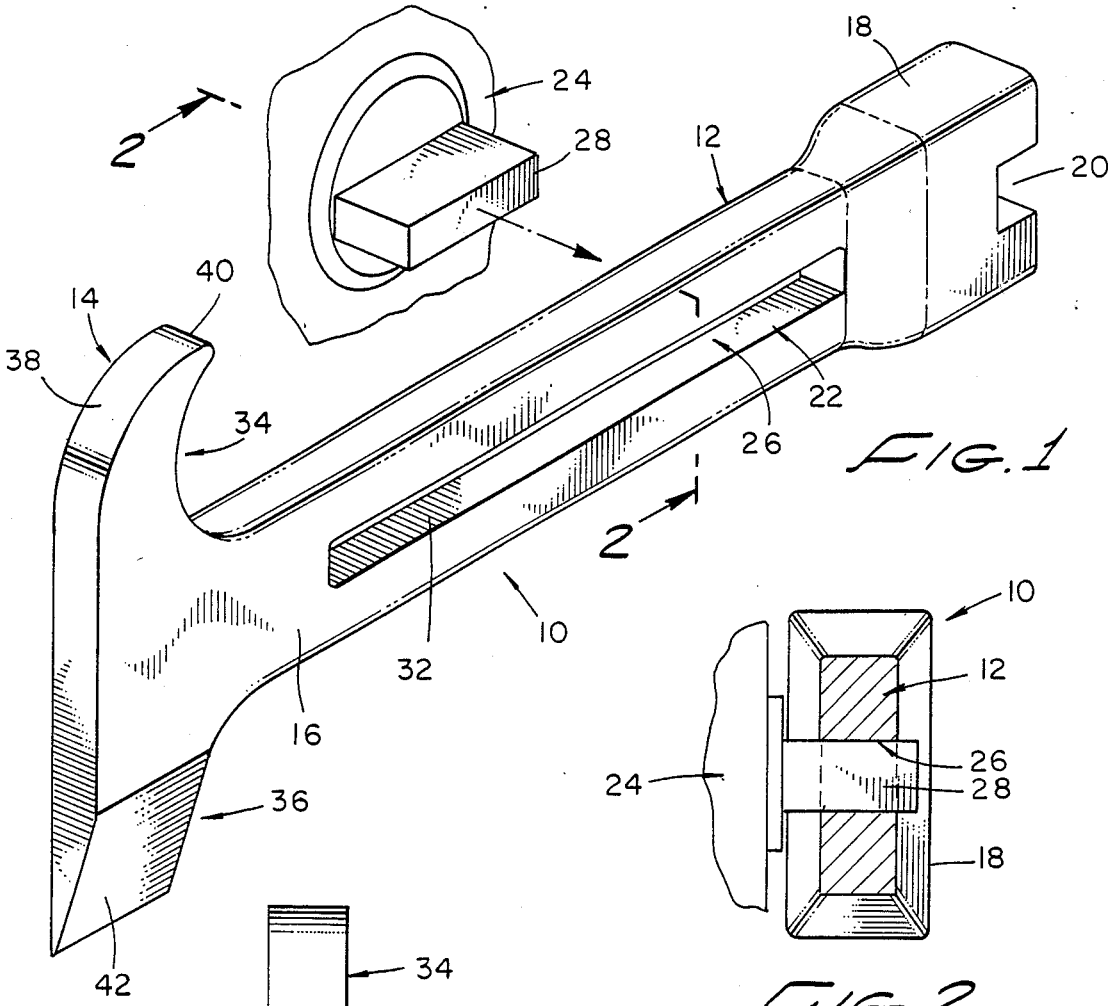
FIG. 1
FIG. 2
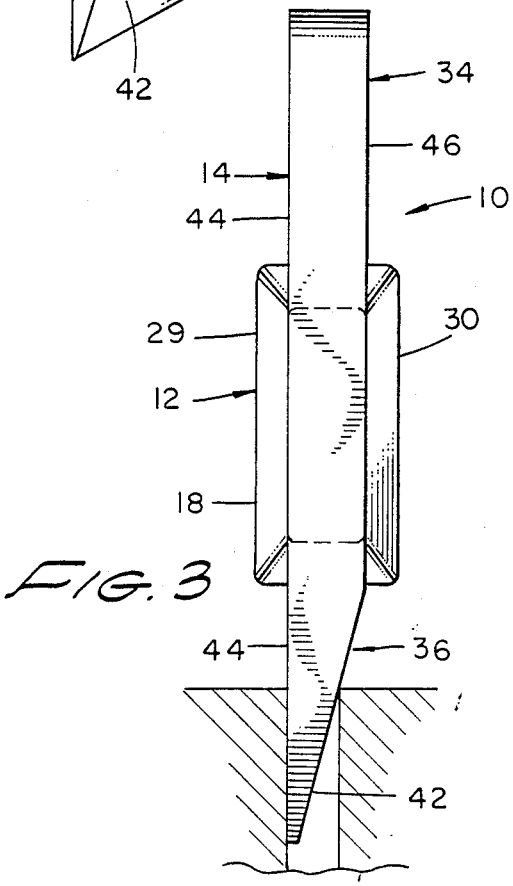
FIG. 3
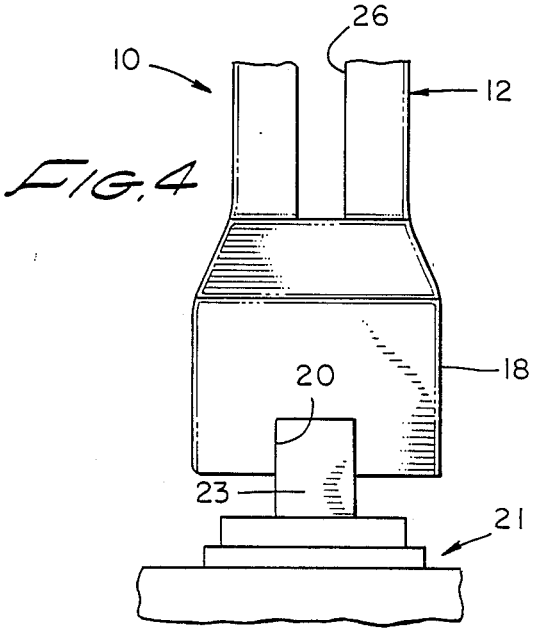
FIG. 4

EMERGENCY TOOL

BACKGROUND

This invention relates generally to the field of hand tools and specifically to the field of hand tools for use after a catastrophic emergency.

Catastrophic emergencies such as floods, landslides, tornados, hurricanes, windstorms, earthquakes, etc. can suddenly strike a residence, a business, a neighborhood or an entire metropolitan area without warning. It is well recognized that individual homeowners should take all steps possible to prepare for such emergencies.

It is universally recommended that, as one step in preparing for a catastrophic emergency, individual homeowners be prepared to shut off pipe lines carrying natural gas into their residences. This step is important to prevent explosions from weakened gas pipes, joints and valves. For similar reasons, it is also recommended that homeowners be prepared to shut off water lines flowing into their residences to minimize the dangers of sudden water line failures and resultant flooding.

It is also generally believed to be important that residential homeowners have handy in the event of a catastrophic disaster tools for opening doorways and other enclosure access ways which might become wedged shut during the catastrophe, and tools for rapidly digging through rubble and debris.

At least four different tools are presently required to prepare a homeowner for the four above-described post-catastrophe tasks. A first tool is needed to shut off gas lines. (Gas line shutoff valves generally are located above ground, usually along the side of the house near the gas flow meter. To close the valve, most gas shutoff valves require turning a valve stem one quarter turn. The valve steam usually has a wrench attachment which is about an inch long and about 7/16 inches wide.) A second tool is needed to shut off water lines. (The shutoff valve for most residential water valves are generally located in a concrete box which is disposed below ground. The valve is generally turned off by turning a valve stem a quarter turn. The valve stem for water shutoff valves is usually quite different from the valve stem for most gas shutoff valves, having a square cross-section about ½ inch on a side.) A third tool is needed to pry open wedged-together doors and other access ways, and a fourth tool is needed to rapidly dig through debris and rubble.

It would be highly desirable to have a single tool which could accomplish all of the above-described four post-catastrophe functions. Such a tool could be stored at a single residence location known to all of the resident's members. Such a tool should be inexpensive to manufacture and simple to use. Unfortunately, such a tool does not exist.

SUMMARY

The invention provides such a single, four-function emergency tool. The emergency tool of the invention comprises an elongate handle having a first end and a second end. The handle defines a rectangular open-end wrench socket with a width transverse to the handle of between about ⅝ inches and about ¾ inches and a longitudinal depth of at least about ⅜ inches. The handle further defines a rectangular box-end wrench socket intermediate between the first end of the handle and the second end of the handle, the box-end wrench socket having a width transverse to the handle of between about ⅜ inches and about ⅝ inches and a longitudinal length of at least about ½ inch.

The open-end wrench socket allows the emergency tool to reach a water shutoff valve disposed below ground and to turn the valve stem to shut off the water. The box-end wrench socket allows the emergency tool to be used to close a residential gas shutoff valve disposed above ground.

In one embodiment of the invention, the emergency tool further comprises a head member attached to the first end of the handle. The head member has a first lateral side which defines a rubbish claw which allows the tool to be used to dig through debris and rubble. The head has a second lateral side which defines a wedge which can be used to pry open doorways and other enclosure openings which may become stuck shut after a catastrophe.

DRAWINGS

These and other features, aspects and advantages of the present invention will become understood with reference to the following description, appended claims and accompanying drawings where:

FIG. 1 is a perspective view of an emergency tool having features of the invention;

FIG. 2 is a cross-section of the emergency tool shown in FIG. 1 along line 2—2;

FIG. 3 is an end view of the head portion of the emergency tool shown in FIG. 1; and FIG. 4 is a side view of the second handle end of the emergency tool shown in FIG. 1.

DESCRIPTION

In one preferred embodiment of the invention, the emergency tool 10 comprises a handle 12 and a head 14. The handle 12 has a first end 16 and a second end 18, with the head 14 being attached to the handle 12 at the first end 16 of the handle 12.

The second end 18 of the handle 12 defines a rectangular open-end wrench socket 20 having a width transverse to the handle 12 of between about ⅝ inches and about ¾ inches and a longitudinal depth of at least about ⅜ inch. It is important that the box-end wrench socket 20 have these dimensions in order for the tool 10 to be useful in closing most standard residential water shutoff valves 21 which generally have valve stems 23 with a cross-section with the shape of a square with ½ inch sides. Preferably, the open-end wrench socket 20 on the second end 18 of the handle 12 has a longitudinal depth of at least about ½ inch and has a width transverse to the handle 12 of about 11/16 inches. These dimensions will allow the tool 10 to be most usable in the closing of the majority of residential water line shutoff valves 21, even when the tool 10 has to be used at an angle relative to the valve stem 23 (e.g., because of space restrictions).

The handle 12 further defines a rectangular box-end wrench socket 22 intermediate between the first end 16 of the handle 12 and the second end 18 of the handle 12. Such box-end wrench socket 22 has a width transverse to the handle 12 of between about ⅜ inches and about ⅝ inches and a longitudinal length of at least about ½ inch. It is important in the invention that the box-end wrench socket 22 have these dimensions so as to allow the tool 10 to be usable in the turning of a standard residential gas main shutoff valve 24. For this purpose, it is preferable that the box-end wrench socket 22 be a groove 26 in the emergency tool handle 12 having a width transverse to the handle 12 of between about ⅜ inches and about ⅝ inches and a length of at least about 1 inch, most preferably at least about 2 inches. Such dimensions will allow the tool 10 to receive most valve stems 28 on residential gas line shutoff valves 24. In the embodiment shown in the drawings, the box-end wrench socket 22 is a groove 26 greater than about 4 inches in length which runs completely through the handle 12 from the upper side 29 of the handle 12 through to the lower side 30 of the handle 12 thereby defining a groove opening 32 in both the upper side 29 of the handle 12 and the lower side 30 of the handle 12). Ideally, the groove 26 in the handle 12 forming the box-end wrench socket 22 has a width transverse to the handle 12 of about ½ inch to receive and be useful in turning valve stems 28 of most residential gas shutoff valves 24.

The handle 12 can be of any convenient length. Typically, the handle 12 is between about 6 inches and about 24 inches, preferably between about 8 inches and about 16 inches. A suitable handle length is about 10 inches. The handle 12 has a circumference which can be conveniently grasped in one hand of the user. Typically, the circumference of the handle 12 is between about 2 inches and about 6 inches.

In a typical embodiment, the transverse width of the handle 12 is between about 1 inch and about 2 inches for easy grip by a user and may be between about ¼ inch and about 1 inch in thickness.

The head 14 has a first lateral side 34 and a second lateral side 36. The first lateral side 34 defines a rubbish claw 38. The rubbish claw 38 has a hook-shaped outermost protuberance 40 which allows the emergency tool 10 to be used to dig through debris and rubble. Preferably, the outer-most end of the protuberance 40 is not sharpened in the same way that the claw on a standard claw hammer is sharpened. The non-sharpened outermost protuberance 40 is important to prevent the outermost protuberance 40 from penetrating debris and rubble. This makes the tool 10 more useful because the user of the tool 10 does not have to continuously remove bits of debris and rubble which become stuck on the outermost protuberance 40.

The second lateral side 36 of the head 14 defines a wedge 42 useful in prying open doorways and other enclosure accesses which may become stuck shut during a catastrophe. The wedge 42 can have a length (in a direction transverse to the longitudinal axis of the handle 12) between about ½ inch and about 3 inches. As shown in the drawings, the wedge 42 can have a uniform width. Widths between about ¾ inches and about 2 inches are typical for tools 10 of the invention. Also, as shown in the drawings, the lower side of the head 44 is disposed within a single plane and the wedge 42 tapers in the direction from the upper side of the head 46 to the lower side of the head 44. This configuration is preferable to emphasize the function of the second lateral side of the head 36 as a wedge instead of as a hatchet.

In a typical embodiment, the head 14 is about 2 inches in height above the handle 12 and has a transverse width between about 4 inches and about 8 inches. A typical width is about 6 inches.

The tool 10 can be made out of a variety of materials having an appropriate combination of weight and strength. Metal materials such as aluminum and steel can be used in the invention. Preferably, for ease of manufacture, for high strength to weight ratio, and for corrosion resistance, the tool 10 is made as an integral unit from cast aluminum.

The tool of the invention provides an excellent single tool for use after a catastrophic emergency. The tool is inexpensive to manufacture and is easy and fast to use for each of four important post-catastrophe functions: shutting off the gas main, shutting off the water main, prying open wedged-together doors and other enclosures and digging through rubble and debris. The tool can be conveniently stored at a permanent location known to each family member. After a catastrophic emergency, each family member can use the tool to perform the above several post-catastrophe functions with relative ease and without extensive direction.

Although the present invention has been described in considerable detail with reference to certain preferred versions, other versions are possible. Therefore, the spirit and scope of the appended claims should not necessarily be limited to the description of the preferred versions contained herein.

I claim:

1. An emergency tool comprising an elongate handle which is between about 6 inches and about 24 inches in length and has a circumference between about 2 inches and about 6 inches for gripping in one hand, wherein:

(a) the handle has a first end and a second end;

(b) the second end of the handle defines a rectangular open-end wrench socket having a width transverse to the handle of between about ⅝ inches and about ¾ inches and a longitudinal depth of at least about ⅜ inches; and (c) the handle defines a rectangular box-end wrench socket intermediate between the first end of the handle and the second end of the handle, the box-end wrench socket having a width transverse to the handle of between about ⅜ inches and about ⅝ inches and a longitudinal length of at least about 1 inch.

2. The emergency tool of claim 1 wherein the longitudinal depth of the open-end wrench socket is at least about ½ inch, wherein the width of the open-end wrench socket transverse to the handle is about 11/16 inches, and wherein the box-end wrench socket is a slot with a width transverse to the handle of about ½ inch.

3. The emergency tool of claim 1 wherein the tool further comprises a head attached to the first end of the handle, the head having a first lateral side which defines a rubbish claw.

4. The emergency tool of claim 3 wherein the rubbish claw defines a lateral-most protuberance which does not have a sharpened end so that the rubbish claw does not readily penetrate rubbish during use.

5. The emergency tool of claim 1 wherein the tool further comprises a head attached to the first end of the handle, the head having a first lateral side and a second lateral side and a second lateral side with the second lateral side defining a wedge.

6. An emergency tool comprising an elongate handle and a head attached to the handle, wherein:

(a) the handle has a first end and a second end and the head is attached to the first end;

(b) the second end of a handle defines a rectangular open-end wrench socket having a width transverse to the handle of between about ⅝ inches and about ¾ inches and a longitudinal depth of at least about ⅜ inches;

(c) the handle defines a rectangular box-end wrench socket intermediate between the first end of the handle and the second end of the handle, the box-end wrench socket having a width transverse to the handle of between about $\frac{3}{8}$ inches and about $\frac{5}{8}$ inches and a longitudinal length of at least about $\frac{1}{2}$ inch; and (d) the head has a first lateral side which defines a rubbish claw and a second lateral side which defines a wedge.

7. The emergency tool of claim 6 wherein the longitudinal depth of the open-end wrench socket is at least about $\frac{1}{2}$ inch.

8. The emergency tool of claim 6 wherein the width of the open-end wrench socket transverse to the handle is about 11/16 inches.

9. The emergency tool of claim 6 wherein the box-end wrench socket has a width transverse to the handle of about $\frac{1}{2}$ inch.

10. The emergency tool of claim 6 wherein the box-end wrench socket has a longitudinal length of at least about 1 inch.

11. The emergency tool of claim 6 wherein the box-end wrench socket has a longitudinal length of at least about 4 inches.

12. The emergency tool of claim 6 wherein the handle has an upper side and a lower side and a box-end wrench socket is a slot running completely through the wrench handle from the bottom side to the top side and defining an opening in both the bottom side and the top side of the handle.

13. The emergency tool of claim 12 wherein the slot has a longitudinal length of at least about 1 inch.

14. The emergency tool of claim 6 wherein the wedge is between about 1 inch and about 3 inches in length.

15. The emergency tool of claim 6 wherein the wedge has a uniform width of between about $\frac{3}{4}$ inches and about 2 inches.

16. The emergency tool of claim 6 wherein the rubbish claw defines a lateral-most protuberance which does not have a sharpened end so that the rubbish claw does not readily penetrate rubbish during use.

17. The emergency tool of claim 6 wherein the length of the handle is between about 8 inches and about 16 inches.

18. The emergency tool of claim 6 wherein the tool is comprised of cast aluminum.

19. The emergency tool of claim 6 wherein the head has a top side and a bottom side, wherein the bottom side of the head is disposed within a single plane and wherein the wedge tapers in the direction from the top side of the head to the bottom side of the head.

20. An emergency tool comprising an elongate handle which is between about 8 inches and about 16 inches and has a circumference between about 2 inches and about 6 inches, and a head attached to the handle, wherein:

(a) the handle has a first end and a second end and the head is attached to the first end;

(b) a second end of the handle defines a rectangular open-end wrench socket having a width transverse to the handle of between about $\frac{5}{8}$ inches and about $\frac{3}{4}$ inches and a longitudinal depth of at least about $\frac{3}{8}$ inches;

(c) the handle has a top side and a bottom side and the wrench defines a rectangular slot about $\frac{1}{2}$ inches in width and at least about 2 inches long, the slot running completely through the handle from the top side to the bottom side;

(d) the head has a first side which defines a rubbish claw having a lateral-most protuberance which is not sharpened, so that the protuberance does not readily pierce rubbish when in use, and a second lateral side which defines a wedge.

* * * * *